United States Patent [19]

Solheim et al.

[11] 4,301,339

[45] Nov. 17, 1981

[54] ELECTRICAL BRIDGE ATTACHED TO HIGH CURRENT SWITCH

[75] Inventors: Peder R. Solheim; Oddmund Wallevik, both of Porsgrunn, Norway

[73] Assignee: Norsk Hydro a.s., Oslo, Norway

[21] Appl. No.: 6,452

[22] Filed: Jan. 24, 1979

[30] Foreign Application Priority Data

Feb. 1, 1978 [NO] Norway ..... 78/0347

[51] Int. Cl.[3] ..... H01H 33/12

[52] U.S. Cl. ..... 200/146 R; 200/144 R; 337/35; 337/143; 337/156; 337/221; 337/401

[58] Field of Search ..... 200/146 R, 144 R; 337/401, 221, 35, 143, 156

[56] References Cited

U.S. PATENT DOCUMENTS

| | | | |
|---|---|---|---|
| 2,167,499 | 7/1939 | Dickinson | 337/156 |
| 2,491,956 | 12/1949 | Curry | 337/35 |
| 2,838,634 | 6/1958 | Kesselring et al. | 337/143 |
| 3,542,987 | 11/1980 | Levy | 200/146 |
| 3,544,843 | 12/1970 | Slettten et al. | 337/401 |

FOREIGN PATENT DOCUMENTS

| | | | |
|---|---|---|---|
| 1087250 | 8/1960 | Fed. Rep. of Germany | 337/221 |
| 1156933 | 7/1956 | France | 337/221 |

*Primary Examiner*—Robert S. Macon

*Attorney, Agent, or Firm*—Wenderoth, Lind & Ponack

[57] ABSTRACT

A high current switch includes first and second contact plates, each having a contact surface. The contact plates are moved between a closed position with the contact surfaces in contact and an open position with the contact surfaces separated. An electric bridge has opposite ends connected to the contact plates and spans the contact surfaces. During opening of the switch, the electric bridge, in the form of a fuse, remains integral and provides a secondary electrical connection between the contact surfaces, thus preventing arcing therebetween. Upon complete opening of the switch, the electrical bridge ruptures.

8 Claims, 4 Drawing Figures

ELECTRICAL BRIDGE ATTACHED TO HIGH CURRENT SWITCH

BACKGROUND OF THE INVENTION

The present invention relates generally to an electrical bridge attached to a high current switch, and more particularly to such a switch used in electrolysis systems including a plurality of electrolytic cells connected in electrical series circuits.

Such switches are used for separating an individual electrolytic cell, e.g. for the manufacture of magnesium, aluminum, etc., from its series circuit for periodic maintenance purposes, without interrupting current flow through the remainder of the cells in the circuit.

There are often more than one hundred cells in the series circuit, and usually the current carrying path goes through a bus-bar from the cathode of one cell to the anode of the next cell. Disconnection of a cell is achieved in practice through the use of one or more "shunting" or "bypass" bars which are connected parallel to the cell so that the current bypasses the actual cell.

The extremely high currents involved, e.g. up to 200,000 amperes encountered in the operating of modern cells and up to 250–300,000 amperes on projected cells of the future, result in severe arcing at the contact surfaces of the bypass bars and the bus-bars during the operations of opening and closing the switch. This presents a safety hazard for the operating personnel and also results in the erosion of the contact surfaces, thereby causing high maintenance costs.

This problem has been met in practice through the reduction of the current in the entire series circuit, or often through completely switching off the current during the engagement of bypass bars. This however is an expensive practice, not only because of the production losses throughout the entire circuit of cells, but additionally since later on there might arise serious irregularities in cell operation due to the reduction or switching off of the current. In recent years several types of high current switches have therefore been developed and put into use. Different models have been presented, the constructions being adapted to complicated bus-bar systems, which are designed e.g. for modern electrolytic series for the production of aluminum, in order to suppress or compensate for detrimental electromagnetic forces. Fast operating switches, designed to withstand the high currents occurring during the short periods of time when the bypass bars are connected to or disconnected from the bus-bars, are the features commonly employed in these prior art switches. However, in spite of the fact that such switches function satisfactorily with regard to personnel safety and production losses, these switches do not solve the serious problem of arcing on the contact surfaces.

U.S. Pat. No. 3,542,987 describes the use of a pair of resiliently mounted secondary contacts which are adapted to protect the main contacts against arcing damage. Such switches are used on electrolysis cells for the electrolysis of water solutions, e.g. for chlorine electrolysis. The switch consists of an adequate number of contact units so that the current load amounts to only a few thousand amperes per contact. One contact in every contact unit is arranged as a secondary contact designed as a resiliently mounted contact arm adapted to engage prior to engagement of the main contacts when the switch is being closed, and to part subsequent to the parting of the main contacts when the switch is being opened. All the contacts are moved through a common eccentric rotary shaft. The construction is complicated and, because of all of the movable and rotating parts, is unsuitable for use in the dusty atmosphere which is typical of a conventional electrolysis hall or system during the electrolysis of melted salts.

SUMMARY OF THE INVENTION

Accordingly, it is an object of the present invention to provide for the fast connecting and disconnecting of individual cells from the remainder of the cells in different types of multicell electrolysis systems operating at high currents and without the danger of arcing and the resultant erosion damage to the contact surfaces.

This object is achieved according to the present invention by providing a switch which includes two contact plates. One of the contact plates is engaged to the one of the two bus-bars which is to be bypass connected, and the other contact plate is moved by means of a conventional pneumatically or hydraulically operated cylinder arrangement and is connected to the other bus-bar through a flexible link. The switch is provided with a secondary conductor which secures an electrical contact between the two contact plates and maintains such electrical contact a short time after the switch has been opened, i.e. after the two contact plates have been separated. The secondary conductor has a cross-section which is small in comparison with the current carrying contact plates, and a fracture occurs in the secondary conductor during the opening of the switch.

A further object of the present invention is the provision of the secondary conductor which is of a simple construction, which is inexpensive to manufacture and which is very easy to assemble.

Still another object of the present invention is the provision of the secondary conductor which need not necessarily be an integral part of the switch construction, but which can be laid (connected) parallel with the switch to the "shunted" bus-bars.

BRIEF DESCRIPTION OF THE DRAWINGS

These and other objects, features and advantages of the present invention will be pointed out and discussed in more detail in the following detailed description, taken with the accompanying drawings, in which.

DETAILED DESCRIPTION OF THE INVENTION

Figure 1:
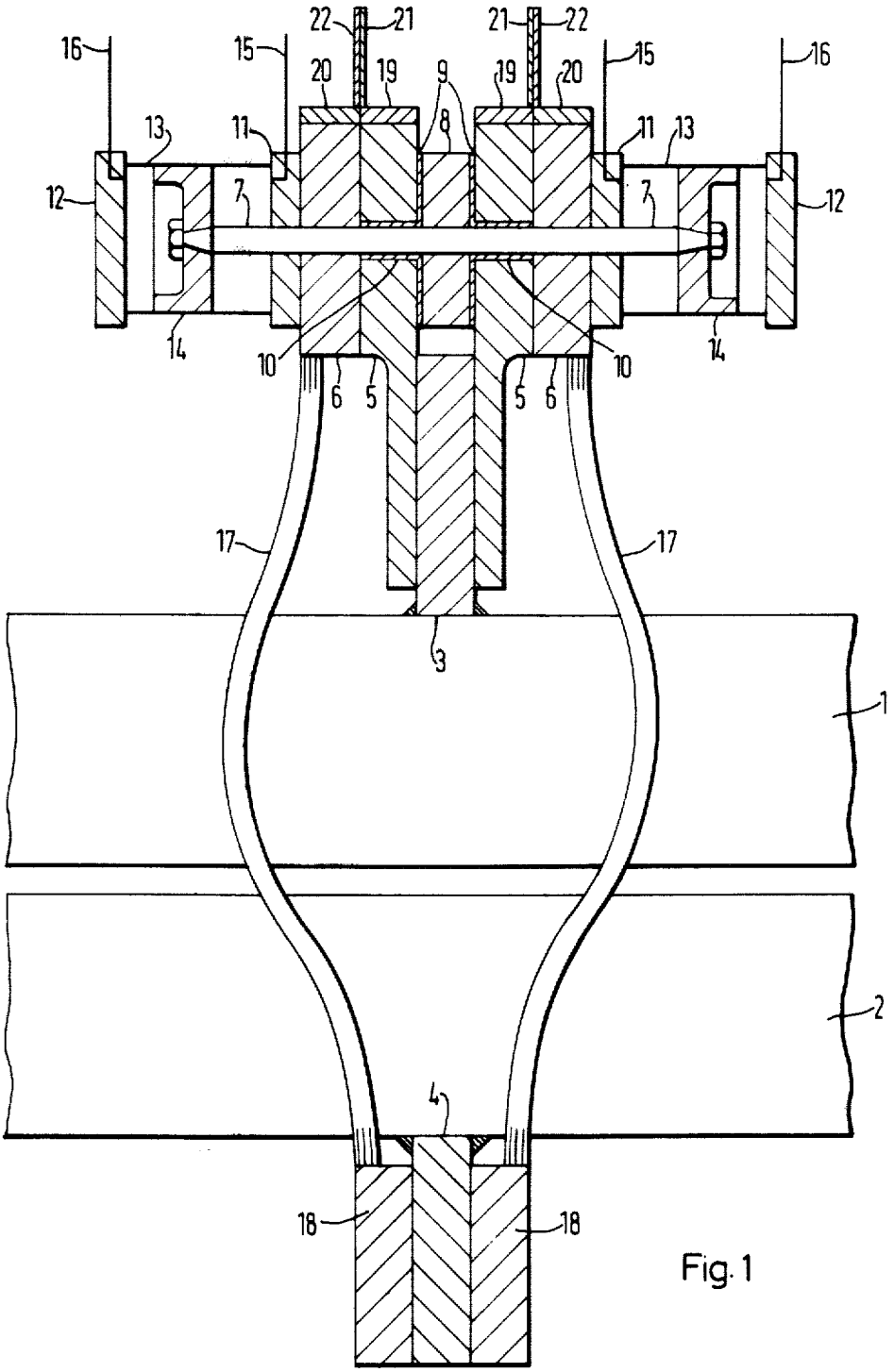
FIG. 1 is a sectional view of an automatic switch constructed in accordance with this invention, as a double switch placed parallel to a bus-bar system alongside an electrolytic cell.

Referring to FIG. 1 of the drawings, there is shown a bus-bar system 1 for anode connection and a corresponding bus-bar system 2 for cathode connection. Both of the bus-bar systems can each include a single bus-bar or can be composed of several parallel single bars.

Across the bus-bar system 1 is welded a fixed current input 3 which carries the current to the anodes of the cells, and correspondingly across the bus-bar system 2 is welded current outlet 4 which carries the current from the cathodes of the cells. In practice, the bus-bar systems are provided with a plurality of current inputs and outlets which are designed so that when bypassing a particular cell they can be connected to each other. The remainder of the construction of the bus-bar systems, the cells and the interconnection of the cells does not in and of itself form the present invention, and thus such construction is not described or illustrated in more detail. It is to be understood that the present invention is applicable for use with all known types of such constructional arrangements.

The switch itself includes contact plates 5 and 6, with the contact plates 5 being fixed to the current input 3, e.g. by means of screws (not shown).

Through the center of the contact surfaces of the contact plates 5 there extends a connecting rod 7 fixed to a spacer 8 positioned between the two contact plates 5.

The connection between the connecting rod 7 and the spacer 8 can be provided as a welded joint or by means of screws, and both elements 7 and 8 are electrically insulated with regard to the contact plates 5 by means of insulation plates 9 and insulation tubes or sockets 10.

The contact plates 6 are slidably mounted on the connecting rod 7 and are attached to powered cylinder-piston units, e.g. pneumatic or hydraulic, which include end pieces 11 and 12, cylinders 13 and pistons 14. Contact plates 6 are fixed to end pieces 11, and pistons 14 are fixed to the connecting rod 7 in such a manner that the element 7, 8 and 14 are immobile.

A driving medium or fluid is introduced into the cylinders through the conduits 15 during the switch closing operation, and through the conduits 16 during the switch opening operation. Thus, when the switch is to be opened from the closed position shown in FIG. 1, fluid is introduced into the cylinders 13 through conduits 16. Since pistons 14 are immovable, the fluid causes end pieces 12, cylinders 13, end pieces 11, and thus contact plates 6 to move outwardly away from respective contact plates 5, thereby opening the switch. Conversely, when the switch is to be closed, fluid is introduced into the cylinders through conduits 15. Since pistons 14 are immovable, the fluid causes end pieces 11, and thus contact plates 6, cylinders 13 and end pieces 12 to move inwardly toward respective contact plates 5, thereby closing the switch.

The contact plates 6 are connected through flexible strips or links 17 to contact plates 18 which are fixed to the current outlet 4, e.g. by means of an ordinary screw connection (not shown). Connection between the flexible links 17 and the contact plates 6 and 18 is provided by means such as welding. The flexible links are preferably composed of thin plates which will provide or yield a slight resistance during the opening and closing of the switch.

Figure 2:
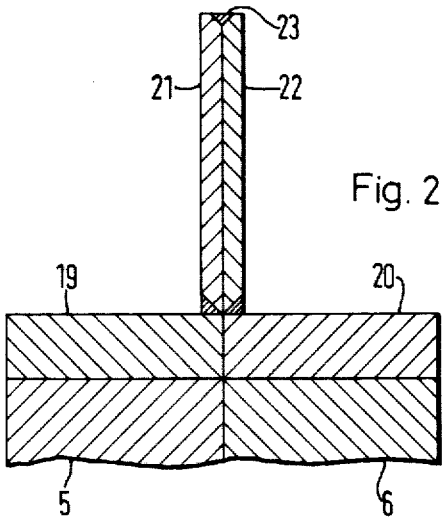
FIG. 2 is an enlarged sectional view of a secondary conductor formed as a "fuse" and used in the switch of FIG. 1, with the switch in the "closed" position.
Figure 3:
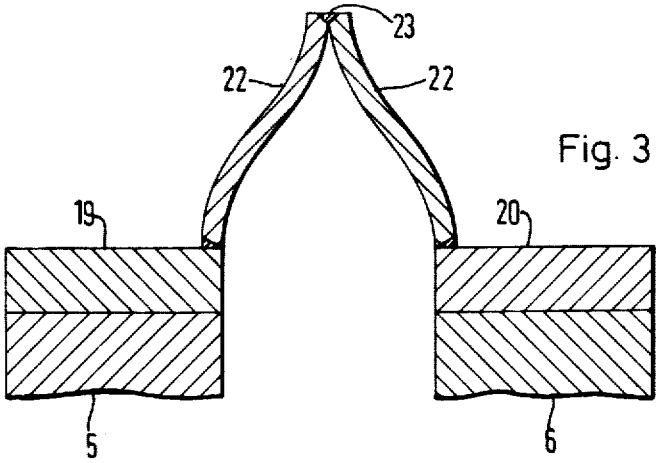
FIG. 3 is a view similar to FIG. 2, but showing the fuse immediately after the switch has been opened and before the fuse has been broken by melting or fracturing.

Before the opening of the switch, each pair of contact plates 5 and 6 are connected together by means of a secondary conductor designed as a "fuse" as shown in FIGS. 2 and 3. The fuse comprises two contact pieces 19 and 20 which are welded to flexible strips 21 and 22, which in turn are connected to each other through a welded joint 23. The contact pieces 19 and 20 are fixed to the contact plates 5 and 6, e.g. by means of screw connections (not shown).

The secondary conductor, constructed as a fuse, maintains the electrical contact or path between the contact plates 5 and 6 for a certain minimal time after the opening of the switch, and in this way protects the contact surfaces of contact plates 5 and 6 against arcing damage which is an unavoidable aspect of high current switching operations performed by prior art switches.

After a certain minimal time after opening movement of the switch, the high current passing through the fuse will melt and thus open the fuse. Melting of the fuse is concentrated preferentially at the welded joint 23, which for this purpose is made to have a small cross-section compared with the cross-section of the strips 21 and 22.

Such "fused" fuses can be fixed to the contact plates 5 and 6 before the closing operation of the switch, and in this way function as secondary contacts and engage prior to the engagement of the contact plates when the switch is being closed. By experience, it has been found that the arc formation during the closing operation is of less extent than the arc formation occuring during the opening of the switch.

Figure 4:
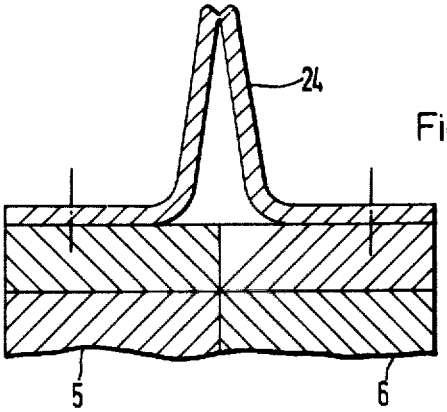
FIG. 4 is a view similar to FIG. 2, but of another embodiment of the secondary conductor.

The present invention is not intended to be limited to the particular forms or usages and described above, and may be carried out in other ways without departing from the spirit and scope of the invention. Thus, the secondary conductor can therefore be constructed in different ways, e.g. as a single piece 24 fixed to the contact plates and having a reduced size fracturable portion, as shown in FIG. 4. Also, the length of the secondary conductor can be adjusted to the length of travel of the cylinders so that the conductor tears or fractures before the switch is fully opened. Although the present invention is shown with regard to a double switch including two contact plates 5 and two contact plates 6, the invention is not limited thereto and may be employed with a switch having a single pair of contact plates or more than two pairs of contact plates.

Other modifications will be apparent to those skilled in the art, and such modifications are intended to be within the scope of the invention.

What we claim is:

1. A high current switch for use in connecting and disconnecting an electrolytic cell in a series connected system of plural electrolytic cells without interrupting current to the remainder of the cells of the system, said switch comprising:

a first contact plate having a contact surface;

a second contact plate having a contact surface;

means for moving one of said first and second contact plates between a closed position whereat said contact surfaces are in contact and an open position whereat said contact surfaces are separated; and flexible secondary conductor means, connected to said first and second contact plates, for forming a secondary electrical connection between said first and second contact plates during movement thereof to said open position, and for thereby preventing arcing between said contact surfaces, said secondary conductor means being positioned such that movement of said contact plates to said open position mechanically deforms said secondary conductor means, said secondary conductor means having a cross-sectional size sufficiently smaller than the size of said contact surfaces such that said secondary conductor means becomes ruptured with movement of said contact plates to said open position.

2. A switch as claimed in claim 1, wherein said secondary conductor means has a reduced cross-section portion of a size to be ruptured by said mechanical deformation.

3. A switch as claimed in claim 1, wherein said secondary conductor means has sufficient flexibility to be deformed without mechanical rupture upon movement of said contact plates to the fully open position thereof, and said secondary conductor means includes a reduced cross-section portion of a size to melt after said fully open position is reached.

4. A switch as claimed in claim 3, wherein said secondary conductor means comprises two strips, said strips being connected at first ends thereof to respective of said contact plates, second ends of said strips being welded together to form a weld which comprises said reduced cross-section portion.

5. A switch as claimed in claim 2, wherein said secondary conductor means comprises an internal single conductor.

6. A switch as claimed in claim 1, wherein said moving means comprises a fluid-operated piston cylinder unit including a cylinder connected to said first contact plate and a piston connected to said second contact plate, and means for causing said piston and cylinder to move relative to each other.

7. A switch as claimed in claim 6, wherein the length of relative movement between said piston and cylinder is greater than the length of said secondary conductor means.

8. A switch as claimed in claim 6, wherein said first contact plate is connected to a first bus-bar by means of a flexible link, and said second contact plate is fixed to a second bus-bar.

* * * * *